United States Patent [19]

Keep, Jr.

[11] 4,069,410

[45] Jan. 17, 1978

[54] HEAT TREATING APPLIANCE AND CABLE

[76] Inventor: Henry Keep, Jr., 88 E. Wharf Road, Madison, Conn. 06443

[21] Appl. No.: 657,452

[22] Filed: Feb. 12, 1976

[51] Int. Cl.[2] ..... H05B 3/58

[52] U.S. Cl. ..... 219/535; 174/109; 174/113 R; 174/124 R; 219/528; 219/530; 219/537; 219/550; 338/214

[58] Field of Search ..... 219/528, 529, 535, 536, 219/537, 549, 550, 552; 174/109, 113 R, 113 C, 124 R, 124 G, 124 GC; 338/214, 213

[56] References Cited

U.S. PATENT DOCUMENTS

| | | | |
|---|---|---|---|
| 3,341,690 | 9/1967 | Commins | 219/528 |
| 3,344,392 | 9/1967 | Briscoe | 219/549 X |
| 3,393,297 | 7/1968 | Hart | 219/528 |
| 3,454,747 | 7/1969 | Hart | 219/549 |
| 3,694,628 | 9/1972 | McGwire et al. | 219/535 X |
| 3,774,013 | 11/1973 | Keep, Jr. | 219/535 |

*Primary Examiner*—Volodymyr Y. Mayewsky
*Attorney, Agent, or Firm*—Albert C. Johnston; Gerard F. Dunne

[57] ABSTRACT

A heat treating appliance coilable about steel piping for heating it before or relieving stresses in it after welding comprises an elongate reticulate sleeve of interlaced heat and oxidation wire having lengths of electrical heating cable each doubled back along itself and fixed inside and along the sleeve so as to form cable legs spaced apart in the sleeve and having terminal portions extending outside it, from respective openings near one end thereof, for connection with a current source. The sleeve has end portions extending beyond the cables therein, and each bent back upon itself into a loop, for securing the appliance in place on the structure to be heat treated. The heating cable has a central solid conductor composed of an electrical resistance alloy, which is covered by a number of braided insulating layers encased in a braided wire sheath; with the inner insulating layers being formed of interlaced refractory strands and thermally decomposable strands so that, upon the first heating of the cable, the decomposable strands burn out and leave the refractory strands in a loosened state on the conductor.

8 Claims, 7 Drawing Figures

HEAT TREATING APPLIANCE AND CABLE

This invention relates to an improved heating appliance for locally heat treating steel piping or like metal structures, such as for relieving stresses developed in the structures by welding operations or for preheating them in preparation for welding. The invention relates also to an improved electrical heating cable for use in high temperature heating appliances.

Reference is made to U.S. Pat. No. 3,774,013 issued Nov. 20, 1973, for a description of the invention that underlies the present improvements.

The form of the heat treating appliance shown in said patent comprises a plurality of lengths of pliable electrical heating cable held spaced apart inside and along a flexible reticular sleeve composed of interlaced heat resistant wire, with end portions of the cable lengths extending from opposite ends of the sleeve to connectors for joining their resistance heating elements to current supply conductors. For using the appliance, it is wrapped in coils about a steel piping or like structure to be heat treated and covered by a heat insulating blanket, and the resistance elements in the cable lengths are connected in parallel through the supply conductors with a current source such as the output terminals of an electric welding machine. Then, by suitable regulation of the current supply, the cable lengths are heated so as to bring the piping at the weld location gradually up to, and afterward gradually down from, a selected heat treating temperature. This temperature as applied for relieving stresses after welding is an appropriate normalizing temperature in the range of about 1100° to 1800° F.

In the use of that known form of the heating appliance, troubles which have been found attributable to a magnetization of the piping sometimes develop in the weldment formed, or occur in the course of welding piping preheated by the appliance. Also, the arrangement of the appliance on the piping with connections to the current source sometimes is troublesome or objectionably time consuming.

It has been found that these troubles can be overcome by an improved arrangement of an elongate reticulate sleeve of interlaced heat and oxidation resistant wire with at least one length of pliable electrical heating cable fixed inside and along the sleeve. According to this improvement, each length of the heating cable in the wire sleeve is doubled back along itself so that it forms two heating legs which are held spaced apart and extend inside the sleeve in substantially parallel relation from a cable loop interconnecting them near one end of the sleeve to and through respective openings in the sleeve near its other end, and the cable legs have terminal portions which extend outside the sleeve from those openings for connection with a source of current.

By virtue of the doubled-back form of each cable length in the appliance coiled about the work structure, the magnetic field generated by the flow of current through either of the cable legs is counteracted by an oppositely directed magnetic field generated by the corresponding current flow through the other leg, so that no troublesome magnetization results in the piping or weldment. Further, since the terminal portions of all the cable legs extend outside the sleeve at one and the same end thereof, they can easily be connected appropriately with a source of energizing current.

It is advantageous to provide two lengths of the heating cable in the sleeve, each doubled back along itself with one spaced inside the other, so that there are two pairs of substantially parallel heating legs which extend from respective cable loops near one end of the sleeve to and through individual openings in the sleeve near its other end. In this way, a desirable high heating capacity is provided while retaining sufficient pliability in the appliance for wrapping it in coils close about the structure to be heat treated.

According to another feature of the present invention, the reticulate wire sleeve comprises at each of its ends a sleeve portion extending beyond the location of the heating cable therein, for securing the appliance in place on the piping or other structure to be heat treated. Each of these extended sleeve portions advantageously is bent back upon and fixed to itself, as by welding its end to its body, in the form of a loop. The sleeve end loops thus provided can be easily drawn tightly toward each other, such as by a tie wire, for fastening the appliance securely in place when it has been wound in coils about a structure to be heat treated.

In the use of the aforesaid known form of heat treating appliance, it has also been found that after a few heat treatments, the electrical resistance wire forming the core of the heating cable sometimes is pulled away from its terminals, and sometimes even burns out, as a result of a contraction of this wire, with shortening of its length, which occurs in some regions of the cable and causes the conductor to be stretched and consequently overheated in other regions. Such contraction, for instance, has shortened the conductor by as much as about 17 inches, or about 7% of its length, in the course of five heating uses of an appliance containing cables of about 21 feet in length. The contraction is believed to be attributable to a kind of "Chinese fingers" effect of the braided layers of insulating material gripping the conductor in the cable coiled and heated to high temperature about the piping.

According to a further feature of the present invention, it has been found that the contraction and burning out of the conductor in the heating cable can be remedied, or at least greatly alleviated, by forming the cable substantially as described in the aforesaid patent excepting that next to the conductor, which is a single solid wire composed of an electrical resistance alloy, the covering layers of electrically insulating material are made to comprise at least one and preferably several braided inner layers each of which is formed of insulating strands of high temperature resistant refractory fibers, such as of amorphous silica, interlaced with strands of thermally decomposable fibers, for example, combustible strands such as cotton threads. The braided-on layer or layers of interlaced thermally decomposable strands and refractory strands are in turn covered by a plurality of superposed braided outer insulating layers, each composed entirely of interlaced strands of high temperature resistant refractory fibers, and the whole is encased in a sheath of interlaced heat and oxidation resistant wire. By virtue of this cable construction, upon the first heating up of the cable to be used in the heat treating appliance, the decomposable strands in the braided inner insulating layer or layers are disintegrated and disappear by thermal decomposition, being burned out in the case of cotton threads, thus leaving the insulating strands of refractory fibers in these layers in a loosened state so that they will exert little or no gripping effect upon the conductor at the center of the cable.

The above-mentioned and other features and advantages of the invention will be further evident from the following detailed description and the accompanying drawings of an illustrative embodiment of the invention.

Figures 1, 2, 3:
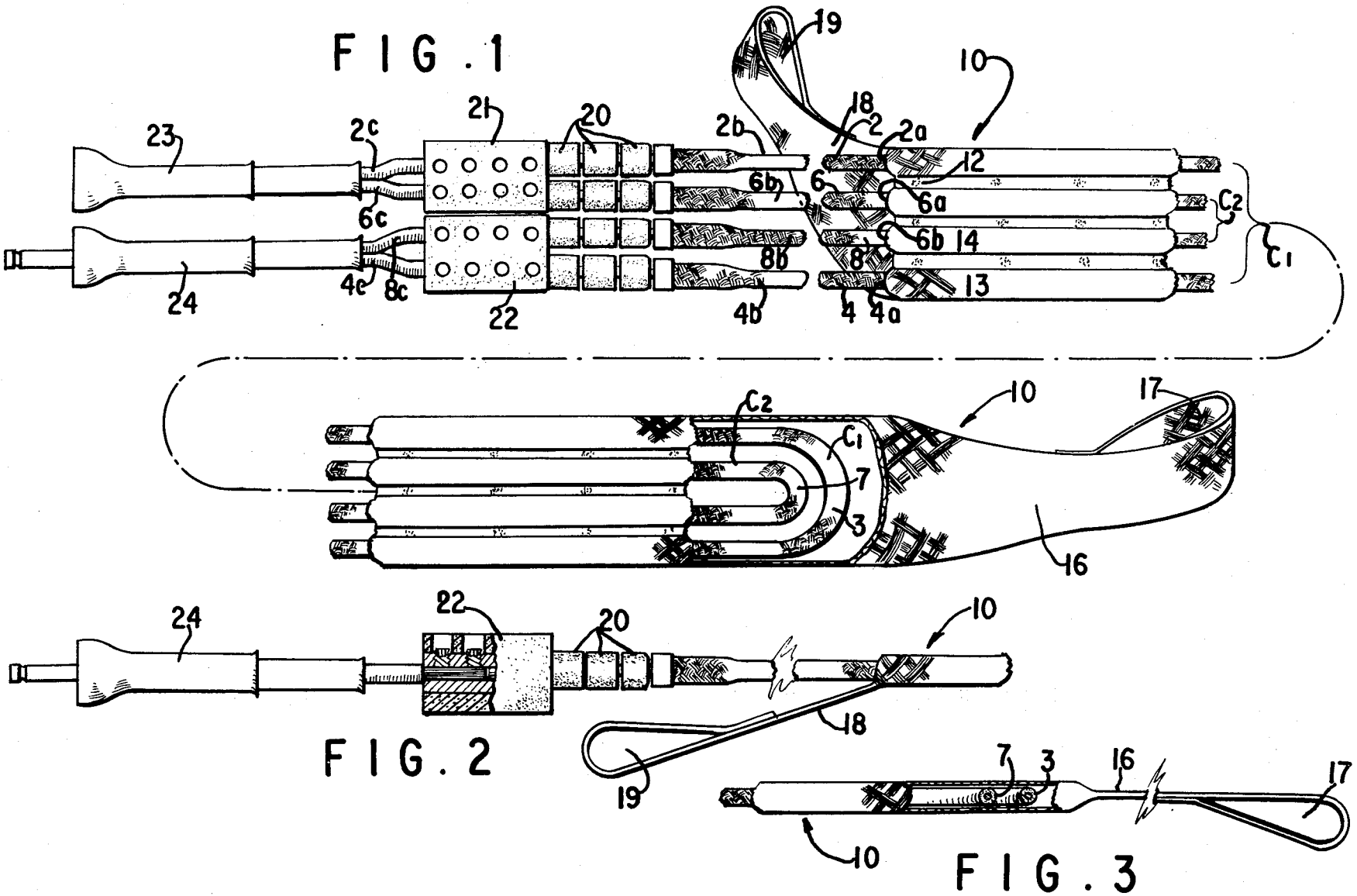
FIG. 1 is a perspective view, partly broken away, of a heating appliance embodying the invention.
FIG. 2 is a side elevational view, partly broken away, of one end portion of the appliance.
FIG. 3 is a similar view of the opposite end portion thereof.
Figure 4:
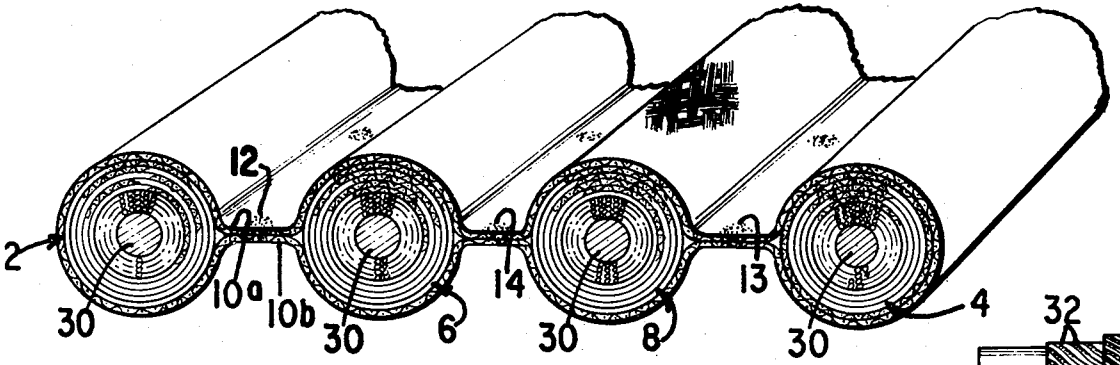
FIG. 4 is a transverse cross-section and partial perspective view on an enlarged scale, taken at line 4—4 in FIG. 1.

In the illustrated embodiment of the invention, as shown in FIGS. 1 and 4, an elongate flexible support 10 formed as a reticulate sleeve of interlaced heat and oxidation resistant wire carries two lengths C1 and C2 of a pliable, high-temperature electrical heating cable C (FIGS. 5 or 6), which are spaced apart one inside the other and each doubled back along itself inside the sleeve so as to form cable length C1 into two substantially parallel heating legs 2 and 4 interconnected by a loop 3, and cable length C2 into two similar heating legs 6 and 8 interconnected by a loop 7.

The sleeve 10 is a suitably long wire mesh tube, or stocking, composed of interlaced bundles of a wire that retains its strength and resists oxidation at the high temperatures produced by the heating cable. The sleeve wire may be, e.g., a chromium-nickel alloy wire of about 0.011 inch diameter composed of "Inconel" No. 601 alloy. While the sleeve may be a knitted open mesh structure, it preferably has an open meash wall structure formed by braiding bundles of the wire, for instance 5-ply bundles, as illustrated in FIG. 4. The cable lengths thus are held in a wire mesh support that is readily flexible in any direction.

Figure 7:
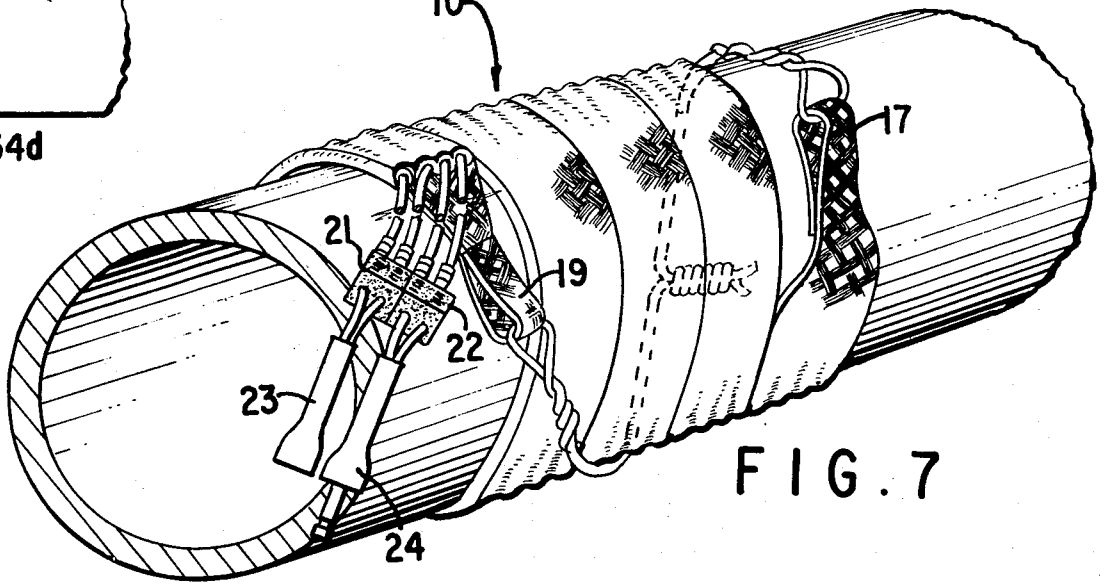
FIG. 7 is a perspective view showing the heating appliance wrapped spirally about a section of steel piping for the heat treatment of stressed regions next to a welded pipe joint.

Depending upon the size of the piping or other structure to be heat treated, there may be one, two, or even three of the doubled back cable lengths held by a reticulate sleeve 10 of appropriate width. Also depending upon the manner of use of the appliance, it may be made with a convenient length, such, for example, as 7 feet, 12 feet, 16 feet or 20 feet, which enables it to be wrapped spirally about a pipe in more than one full convolution thereupon, for instance as illustrated in FIG. 7, yet also to be coiled to a compact form for simplicity of storing and transporting the appliance.

In making the appliance shown, the outer length C1 of the heating cable is doubled back along itself and placed within the support sleeve 10, with its legs 2 and 4 spread apart to engage opposite sides of the sleeve wall, and the legs are passed through respective mesh openings **2*a* and 4*a* near one end of the sleeve. From these openings respective terminal portions 2*b* and 4*b* of these legs extend outside the sleeve for connection with a source of electric current. Then the opposite wall sections 10*a* and 10*b* of the sleeve are joined together in regions 12 and 13 extending therealong adjacent to the inner sides of the cable legs 2 and 4 and their loop 3. The sleeve wall sections preferably are so joined by having their meshes welded together, as by resistance welding, at intervals along those regions. The inner cable length C2 then is doubled back along itself and placed in the sleeve 10 so that its legs 6 and 8 and their connecting loop 7 lie inside and adjacent to the joined sleeve wall regions confining the outer cable length, with these legs extending through respective mesh openings 6*a* amd 8*a* near one end of the sleeve and continuing outside the sleeve in respective terminal portions 6*b* and 8*b* for connection with the current sources. Then meshes of the confronting wall sections of the sleeve are joined together along a middle region 14** thereof, adjacent to and inside the legs and loop of the inner cable length, as by being welded together at intervals therealong. Thus, the lengths of heating cable are secured and maintained in place in the support sleeve at a desired spacing from each other, for example, at a mutual spacing of about ½ inch or a center to center distance of about ¾ inch each from another.

As shown in FIGS. 1, 2 and 3, the sleeve 10 has at one of its ends a portion 16 thereof extending beyond the location of the cable loops 3 and 5, and has at its other end a portion 18 extending beyond the location where the cable legs 2, 4, 6 and 8 pass outside the sleeve. These sleeve end portions each serve as a kind of strap and handle for securing the appliance in place on the structure to be heat treated. They facilitate the wrapping of the appliance in coils fitting closely about a pipe structure, after which they can be drawn tightly toward each other and tied together, as by a tie wire, for fastening the appliance securely in place. Their serviceability in these respects is enhanced by forming them into loops 17 and 19 at the opposite ends of the sleeve, as by doubling each of the end portions 16 and 18 back onto itself and welding or otherwise fixing the wires at its end to wires along its body. The loops 17 and 19 are easily maneuverable for manipulation of the appliance and also are ready for engagement by a tie wire or like device to fasten the appliance in place for use.

The terminal portions **2*b*, 6*b* and 4*b*, 8*b* of the cable legs, which extend outside the sleeve 10 through the mesh openings 2*a*, etc., near one end thereof, have their respective resistance heating elements 30 passed through loose ceramic spacers 20 and thence into electrically conductive tubes inside ceramic terminal blocks 21 and 22, respectively, in which these elements are anchored in relatively fixed positions by set screws threaded in bores of the blocks. Electrical supply conductors 2*c*, 6*c* and 4*c*, 8*c*, respectively, having little resistance so nonheating, extend into these same tubes at the other ends of the blocks and are similarly anchored therein. The two pairs 2*c*, 6*c* and 4*c*, 8*c* of supply conductors extend from respective electrically insulating connector sleeves 23 and 24, in which they are joined together and by which they may be readily connected with a current supply circuit, such, for example, as the current output terminals of a conventional electrical welding machine, so that the cable lengths C1 and C2** will be energized in parallel.

Figure 5:
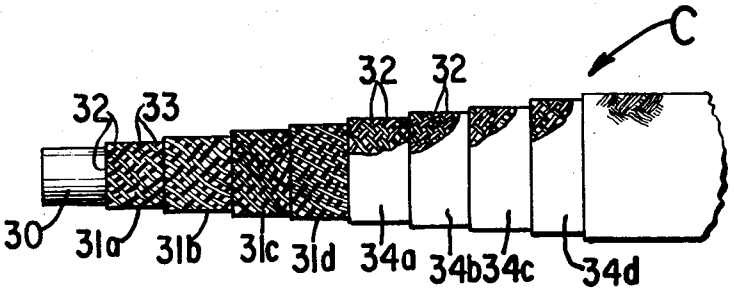
FIG. 5 is a fragmentary side elevational view, partly broken away, of the structure of the electrical heating cable.
Figure 6:
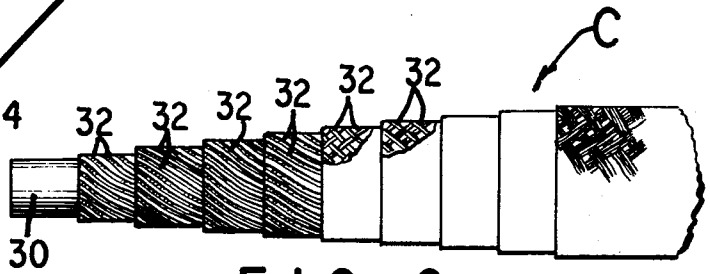
FIG. 6 is a view similar to FIG. 5 of the cable structure remaining after a heating of the cable.

The structure of the heating cable provided for use in the appliance is illustrated in FIGS. 5 and 6. The core 30, or resistance heating element, of the cable C is a single solid strand of an electrical resistance wire such, for example, as a No. 12 gauge, or 0.081 inch diameter, wire composed of an alloy of 80 percent nickel and 20 percent chromium. This conductor is covered by a number of superposed electrically insulating layers having good heat conductance. The insulating covering is formed initially, for example, by braiding upon the conductor 30, in succession, four inner sheathing layers 31*a*, 31*b*, 31*c* and 31*d*, each composed of strands 32 of high temperature resistant refractory fibers interlaced with strands 33 of thermally decomposable fibers, and then braiding upon these inner layers, in succession, four outer layers 34*a*, 34*b*, 34*c*, and 34*d*, each composed entirely of interlaced strands 32 of high temperature resistant refractory fibers. The refractory strands are composed, for example, of an amorphous silica fiber such as that known commercially as "Refisil", which is resistant to temperatures as high as about 3,100° F. The decomposable fiber strands 33 may be composed of a combustible organic substance; for instance, they are strong cotton threads. The whole insulating covering is encased in a shielding sheath of interlaced heat and oxidation resistant wire, such as by braiding tightly upon it a layer composed of groups of "Inconel" No. 601 chromium-nickel alloy wires, each group being composed of five parallel wires of No. 32 gauge, or about 0.008 inch in diameter.

When the cable structure formed as above described is subjected to its first heating operation, which may occur either in a preliminary test of the cable or in the first practical use of a heat treating appliance containing it, the thermally decomposable strands of each inner insulating layer 31*a*, etc., are decomposed by the heat of the conductor 30. Being composed of an organic substance, e.g. cotton fibers, these strands burn out and leave the cable structure with inner layers composed only of spirally layered refractory strands 32, as indicated in FIG. 6. It results that the refractory strands of the inner insulating layers, being no longer interlaced with other strands, are now in a loosened state. This enables the cable to be coiled about a work piece and heated to a high temperature without causing the conductor therein to be gripped tightly and deformed by the adjacent layers of insulating material.

The heat treating appliance herein set forth can be readily flexed by hand and wrapped spirally in coils upon and about a welded steel pipe or like structire, and then connected in an electrical supply circuit of suitably low voltage and high amperage, for the efficient performance of stress relieving heat treatments. The appliance is also highly useful for pre-heating pipeing before welding it. The presence of the connector sleeves 23 and 24 at one and the same end of the appliance makes it relatively easy to arrange the appliance in connection with the current source. The doubled back form of each of the cable lengths C1 and C2 in the sleeve 10 obviates the previously troublesome magnetization of the piping.

The appliance will readily develop an extremely high temperature, up to about 2,000° F. or even higher if desired, in the regions of the piping or other structure upon which it is wrapped. It is resistant to oxidation or other deterioration at these temperatures, and also to becoming broken or damaged under the mechanical stresses of being wrapped about a pipe for use and of being coiled into a compact form for storage or transport when not in use.

For stress-relieving relatively small pressure piping, such, for example, as welded steel pipe of 10-inch O.D. having a wall ¾ inch thick, a single unit of the heat treating appliance may be wrapped spirally about the stressed region of the pipe. A typical manner of applying the heating appliance to such pipe is illustrated schematically in FIG. 7. A heat-insulating blanket (not shown) is fitted over the appliance before the heat treating cycle is initiated, such as by wrapping a web of a "Kaowool" insulating material over the coils to conserve the heat they will generate. The stress relieving treatment then is carried out over a period of hours by a regulated source of energization of the heating appliance, according to conditions established by engineering codes for the type of pipe being treated. Typically, the stressed region of the pipe is heated gradually in specified stages to a specified high temperature suited for normalizing its metal structure, which temperature is held for a prescribed time, and then, by reduction of the current flow, the appliance and the pipe are caused to cool gradually at a controlled rate until a non-stressing temperature, for example of 600° F. or less, is reached.

For relieving stresses in a massive steel pipe adjacent to a welded joint thereof, such as in a pipe of 48-inch outside diameter having a wall 5½ inch thick, several units of the heat treating appliance, each for example of about 20 feet in length, are wrapped side-by-side spirally upon and about the stressed region of the pipe. The several units are suitably connected in parallel in an electrical supply circuit and then are covered by a heat insulating blanket, after which the heat treating cycle is carried out according to prescribed standards.

What is claimed is:

1. In an appliance adapted to be coiled about a steel pipe or like structure for heat treating it before or to relieve stresses in it after welding, comprising an elongate reticulate sleeve of interlaced heat and oxidation resistant wire and at least one length of pliable electrical heating cable fixed inside and along said sleeve, said cable comprising a central conductor composed of an electrical resistance alloy and a plurality of contiguous layers of high temperature resistant insulating material covering said conductor and encased in a sheath of interlaced heat and oxidation resistant wire, the improvement which comprises each cable length of said at least one cable length being doubled back along itself to form two heating legs held spaced apart and extending inside said sleeve from a cable loop interconnecting them near yet inside one end of the sleeve to and through respective openings in the sleeve near its other end, said legs having terminal portions extending outside said sleeve from said openings for connection with a source of current, said sleeve comprising at each said end a portion thereof extending beyond said at least one cable length therein for securing the appliance in place on the structure to be heat treated.

2. A heat treating appliance according to claim 1, each said extending end portion of said sleeve being bent back upon and fixed to itself in a loop, thus providing sleeve end loops for securing the appliance in place on the structure to be heat treated.

3. In a heat treating appliance according to claim 1, the further improvement wherein said layers of insulating material comprise a plurality of superposed braided outer layers each composed of interlaced strands of high temperature resistant refractory fibers and, between said outer layers and said conductor, at least one braided inner layer composed of strands of high temperature resistant refractory fibers interlaced with strands of thermally decomposable fibers.

4. In a heat treating appliance according to claim 1, the further improvement wherein said layers of insulating material comprise a plurality of superposed braided outer layers each composed of interlaced strands of high temperature resistant refractory fibers and, between said outer layers and said conductor, at least one inner layer composed of strands of high temperature resistant refractory fibers in a loosened state produced by decomposition of strands of thermally decomposable fibers previously braided therewith over said conductor.

5. An appliance adapted to be coiled about a steel pipe or like structure for heat treating it before or to relieve stresses in it after welding, comprising an elongate reticulate sleeve of braided heat and oxidation resistant wire and two lengths of pliable electrically insulated electrical heating cable fixed inside and along said sleeve, said cable lengths being spaced apart one inside the other and each being doubled back along itself to form a pair of heating legs extending in substantially parallel spaced relation inside said sleeve from a cable loop interconnecting them near one end of the sleeve to and through respective openings in the sleeve near its other end, said legs being held spaced apart in said sleeve by intervening adjoined wall portions of the sleeve and having terminal portions extending outside said sleeve from said openings for connection of said cable lengths in parallel with a source of current, said sleeve comprising at each said end a portion thereof extending beyond said cable lengths therein and bent back upon and fixed to itself in a loop, thus providing sleeve end loops for securing the appliance in place on the structure to be heat treated.

6. An appliance according to claim 5, each said cable length comprising a central conductor that is a single solid wire composed of an electrical resistance alloy, a plurality of inner insulating layers superimposed upon said conductor and each composed of strands of amorphous silica fibers in a loosened state produced by thermal decomposition of strands of combustible fibers previously braided therewith over said conductor, a plurality of outer insulating layers braided one over another upon said inner layers and each composed entirely of interlaced strands of amorphous silica fibers, and a sheath of heat and oxidation resistant wire braided upon said outer layer.

7. An electrical heating cable for a heat treating appliance, comprising a central conductor that is a single solid wire composed of an electrical resistance alloy, a plurality of inner insulating layers braided one over another upon said conductor and said composed of strands of high temperature resistant refractory fibers interlaced with strands of thermally decomposable fibers, a plurality of outer insulating layers braided one over another upon said inner layers and each composed entirely of interlaced strands of high temperature resistant refractory fibers, and a sheath of heat and oxidation resistant wire braided upon said outer layers.

8. An electrical heating cable according to claim 7, but each of said inner layers being composed of its said strand of refractory fibers in a loosened state produced by decomposition of said strands of thermally decomposable fibers.

* * * * *